United States Patent [19]

Sahlberg

[11] Patent Number: 4,704,982

[45] Date of Patent: Nov. 10, 1987

[54] ANCHOR ARRANGED FOR LOWERING ALONG AN INCLINED PLANE

[76] Inventor: Agge Sahlberg, Dammtrapgatan 34, S-121 63 Johanneshov, Sweden

[21] Appl. No.: 851,030

[22] Filed: Apr. 11, 1986

[30] Foreign Application Priority Data

May 3, 1985 [SE] Sweden ..... 8502187

[51] Int. Cl.[4] ..... B63B 21/24

[52] U.S. Cl. ..... 114/304; 114/293; 114/301

[58] Field of Search ..... 114/293, 294, 297, 298, 114/299, 301, 303, 304, 307, 308, 309, 310

[56] References Cited

U.S. PATENT DOCUMENTS

| | | | |
|---|---|---|---|
| 2,480,188 | 8/1949 | Gardiner | 114/304 |
| 2,722,191 | 11/1955 | Johnson | 114/304 |
| 3,611,974 | 10/1971 | Joppa | 114/294 |
| 3,946,695 | 3/1976 | Isaak | 114/293 |
| 4,523,539 | 6/1985 | Granger | 114/299 |

FOREIGN PATENT DOCUMENTS

| | | | |
|---|---|---|---|
| 0121183 | 6/1985 | Japan | 114/298 |

*Primary Examiner*—Jeffrey V. Nase
*Assistant Examiner*—Edwin L. Swinehart
*Attorney, Agent, or Firm*—Flynn, Thiel, Boutell & Tanis

[57] ABSTRACT

What is proposed in accordance with the invention is a sea anchor so arranged, after having been dropped, as to be capable of gliding obliquely forwards through the water along a flat, inclined plane so as to land on the bottom in a holding position at a considerable horizontal distance from the boat or vessel which dropped the anchor. For this purpose the shank of the anchor is combined with a transverse wing corresponding to the pair of arms of the conventional anchor. The wing has a marked 'V' form and is noticeably swept back, causing it to adopt a stable attitude during its glide through the water, in conjunction with which it takes with it an achor rope which further stabilizes its glide. The wing as a whole is preferably pivotally connected to the anchor leg, for example by means of a pivot bolt, in which case the central section of the wing is extended rearwards to a spade-like, tapering structure which ends in a point. The arrangement is such that, once the anchor has reached the bottom and when a pull is applied to the anchor rope, the wing will be folded out from the anchor leg, when its rearward-tapering section will act as an anchor fluke and will dig into the bottom in the same way as previously disclosed anchors with folding flukes.

12 Claims, 9 Drawing Figures

10
12
30
20
15
14
16
18

10
28
15
28
30
20

10
12
28
20
25'
26'
25
26
15
16
18
30
25'
26'

P
18
15
25'
26'
30
31
γ
20
25
26'

Fig.7
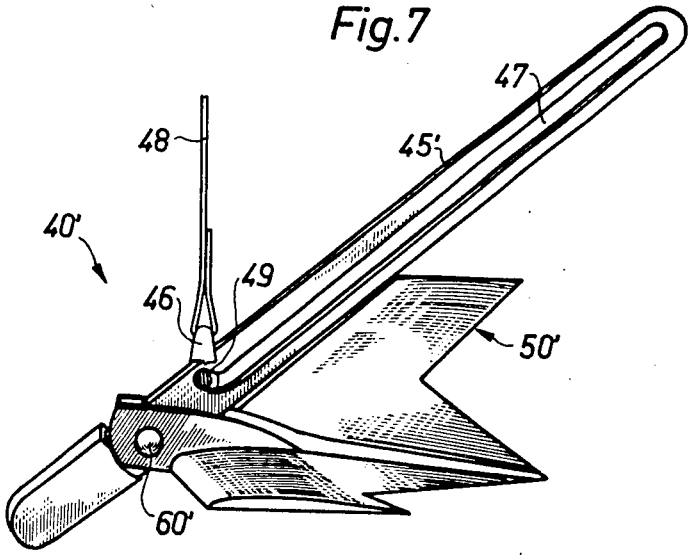
Fig.8
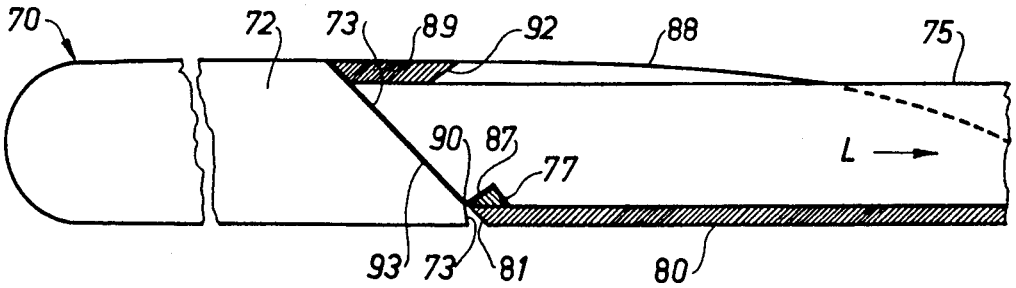
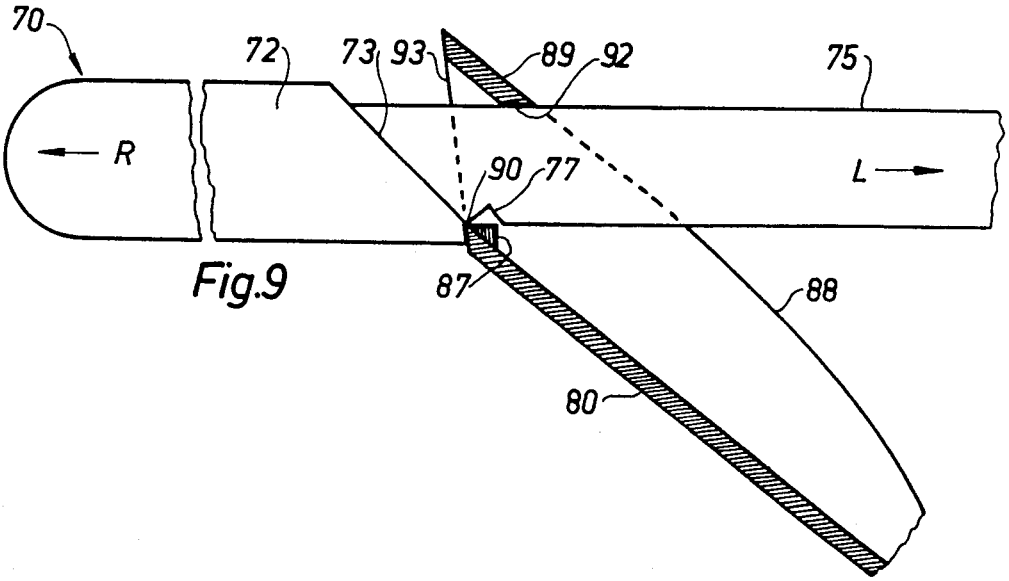
Fig.9

ANCHOR ARRANGED FOR LOWERING ALONG AN INCLINED PLANE

The present invention relates to anchors, and more specifically to anchors for watercraft. In accordance with the invention an anchor of this kind is so arranged, when being lowered to the bottom, as to follow an oblique or inclined path.

As is already familiar, anchoring with the help of a conventional anchor takes place in such way that the anchor is deployed whilst the boat or vessel is still some distance away from the intended anchoring place. The anchor sinks more or less straight down to the bottom, whilst the boat continues on its way. The anchor drags for a few moments before gripping, whereupon the boat is anchored by means of the anchor rope or anchor chain which extends obliquely outwards and down to the anchor lying and fixed on the bottom.

Conventional anchoring obviously requires the one or more persons responsible to have experience of and to be very familiar with the anchoring procedure if the boat is to be firmly anchored at the intended place; rapid and accurate anchoring is by no means easy to achieve under any circumstances.

The object of the invention is thus to simplify the anchoring procedure by making it possible to position the boat first at the intended anchoring place and then to drop the anchor, said anchor being executed in such way that it will not drop straight down through the water but will glide along a fairly flat, inclined plane away from the boat. Once it has landed on the bottom it can be made to drag and to take a grip by being operated for the entire period from a stationary boat lying at the intended anchoring place.

Previously disclosed in, for example, Swedish Pat. No. 344 720 (equivalent to U.S. Pat. No. 3,611,974), is the principle of sending out anchoring arrangements from a given point in different directions and obliquely downwards towards the bottom. The devices concerned here are intended primarily for anchoring buoys with the help of two or more weights lying on the bottom; these are not, therefore, in the form of gripping anchors. The weights consist of cylindrical bodies executed as small aeroplanes with wings and stabilizers, and it is possible with the help of these devices to cause the body to glide obliquely down towards the bottom, albeit at a rather steep glide path of about 45°.

The object of this invention is, on the other hand, to propose a true gripping anchor which also follows an oblique path at an angle to the bottom, but which is a good deal flatter than the glide path of the previously disclosed arrangement, to the extent that the path exhibits a so-called gliding ratio of between 1:4 and 1:5, that is to say the path is inclined towards the bottom at an angle of the order of 12°–15°. This means that the anchor can be deployed for a considerable distance from the boat before it lands on the bottom if the boat has about 4–5 meters of water beneath the keel, then the anchor can be made to find a secure grip at a distance of 15 to 25 m from the boat, thereby providing advantageous anchoring conditions.

The performance of the anchor in accordance with the invention is strikingly obvious from the very start; this is no lightweight object, but rather a solid iron structure which, in accordance with the invention, is so executed as to exhibit, in addition to its ability to glide, an ability to find a grip on the bottom apparently rapidly and effectively as the anchor cable behind the anchor is tensioned. The principle by which the 'gliding anchor' in accordance with the invention is able to exhibit such an ability to glide along a flat path through the water is easily appreciated from a comparison of the aerodynamic and hydrodynamic parameters: in principle the anchor in accordance with the invention glides through the water in the same way as a glider aircraft glides through the air, and both are subject to the same rules and formulae in respect of lift and drag. These formulae are known to include the density of the medium as a directly proportioning factor, and bearing in mind the fact that the density of water is about 775 times greater than that of air, it is easy to appreciate that an 'aircraft' in water can be made quite heavy compared with a similar aeroplane intended to glide through the air.

The invention is now described with reference to the accompanying drawings, which illustrate for entirely exemplifying and non-restricting purposes a proposal for the execution of the anchor in accordance with the invention.

FIGS. 1 to 3 in the drawing thus portray a side, plan and front view respectively of an anchor executed in accordance with the invention, with all of the Figures being drawn in a highly schematic manner and in such a way that they illustrate the principle of the invention as clearly as possible.

FIG. 7 is a schematic representation on a smaller scale of a somewhat modified anchor in accordance with FIGS. 5 and 6 viewed from the side in a suspended position.

Finally, FIGS. 8 and 9 are detailed sections through the central part of a further modified anchor in the gliding attitude, whilst FIG. 9 shows the same part of the anchor in the engagement position.

Figure 1:
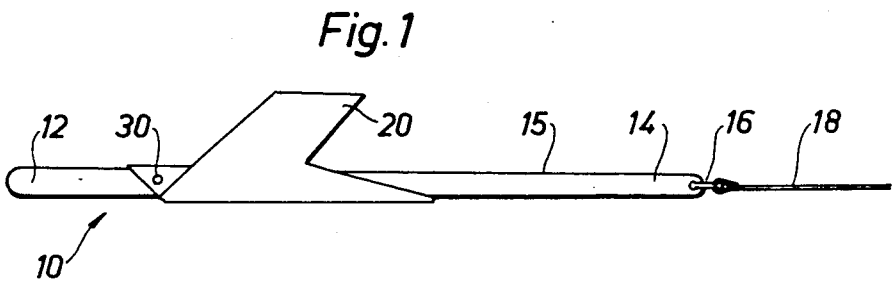
Figure 3:
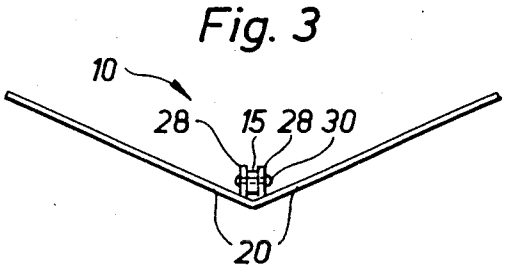
Figure 2:
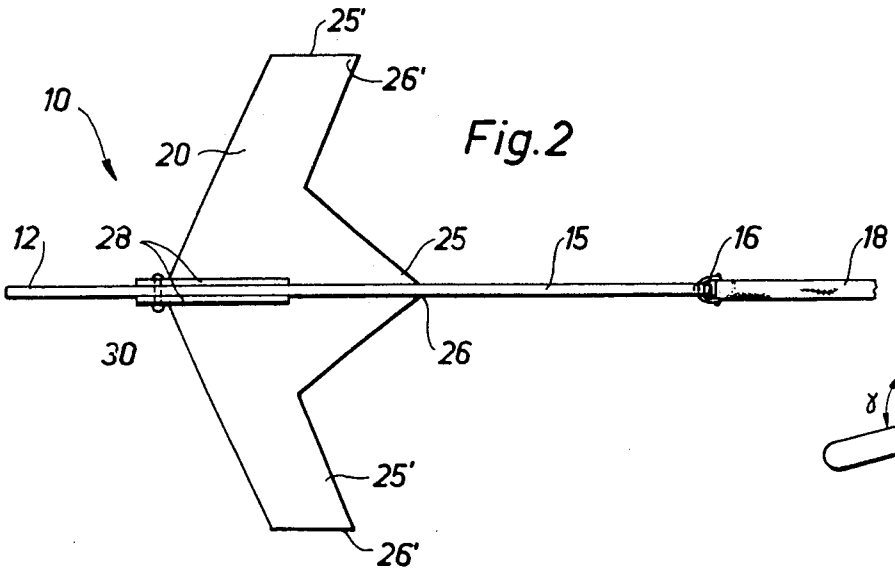

FIGS. 1 to 3 thus schematically illustrate an anchor 10 in accordance with the invention, said anchor consisting of - if we are to apply the traditional designations for parts of anchors - an anchor shank 15 in the form of a straight bar or rail constituting the crown 12 of the anchor at the front and the head 14 of the anchor at the rear. Attached to the head is a shackle or tube 16 for the connection of an anchor rope 18.

The arms of the anchor project from the shank 15 behind the crown 12 running transversely across the shank, and in accordance with the invention these arms have the form of a continuous wing 20, which is now described in greater detail. For the purposes of attaching the wing 20 to the anchor shank 15, the former is provided with two centrally arranged, longitudinal bars or ribs 28 (see in particular FIGS. 1 and 3) which between them accommodate the shank 15. This is pivotally attached to the bars by means of an articulated link 30, for example in the form of a bolt or pin. The pair of arms or the wing 20 is thus pivotally attached to the anchor shank 15 for a purpose which will be described later.

The schematically illustrated anchor in accordance with the invention will be seen to present the appearance of a stylized aeroplane, in which the shank 15 corresponds to the fuselage and the pair of arms 20 corresponds to the wing of the aeroplane. This will be seen to be noticeably swept back (see FIG. 2) and to exhibit a marked 'V' form (see FIG. 3). The trailing edge of the wing exhibits, as may also be clearly seen, an interrupted plane profile, and the central part of the wing is extended rearwards to form a point 26 resulting in a triangular, spade-shaped part 25, as may be appreciated from FIG. 2 in particular. This part 25 corresponds to an anchor fluke on a conventional anchor, and the actual tip 26 thus constitutes a point. There is no separate device corresponding to the stabilizer fin of an aircraft.

When the anchor 10 is lowered into the water, adopting an essentially horizontal position in accordance with FIG. 1, it will immediately glide obliquely forwards in the water along an inclined glide path with the water arriving at a certain angle of attack against the wing 20 of the anchor, just as in the case of a conventional aircraft or glider aircraft as it glides through the air. The size and position of the anchor shank 15 in relation to the pair of arms or the wing 20 is matched to the principal forces acting upon the anchor, which, as in the case of an aircraft, consist of a resulting lifting force acting on the wing 20, a resulting drag force acting on the anchor as a whole and countering the forward gliding motion, plus the weight of the anchor, said forces balancing one another out precisely as in an aircraft. In this case the drag force includes a component for the anchor rope 18 which the anchor draws with it through the water and which also stabilizes the anchor as it glides forwards. The anchor rope 18 consists preferably of a strip of modern, synthetic material such as is described in patent 8300513-2. A strip of this kind is extremely strong and presents fairly low resistance to being pulled forwards through the water.

Thanks to its design in accordance with the principles of aerodynamics and hydrodynamics, the anchor in accordance with the invention will glide forwards in a stable manner along an essentially rectilinear path, the inclination of which is determined primarily by the detailed execution of the anchor wing 20. It has been found to be possible in practice to achieve fairly flat glide paths, especially if the aforementioned, strip-shaped type of anchor rope 18 is used. As already mentioned, gliding ratios of between 1:4 and 1:5 have been achieved.

Figure 4:
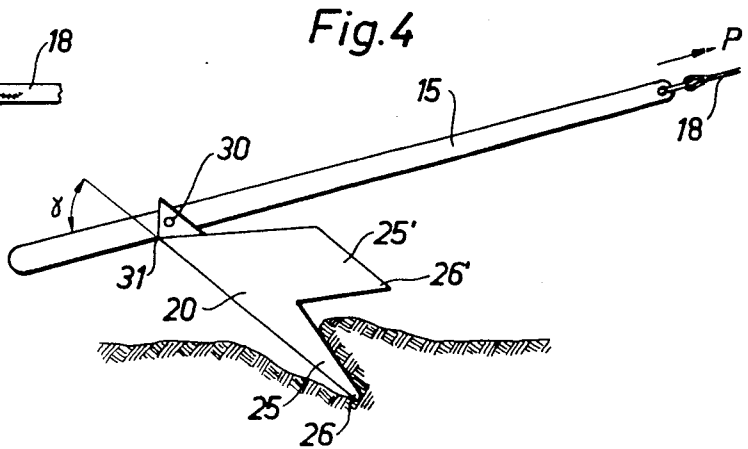
FIG. 4 is a side view, similarly schematic in nature, of the anchor in accordance with the invention and shows it in an initial phase of its engagement with the bottom of the sea or the bed of a lake.

As indicated above, the anchor wing 20 is connected to the shank 15 by means of an articulated link 30. This is situated at or close to the leading edge of the wing (see FIGS. 1 and 2), which means that the wing 20 as a whole can be folded downwards in relation to the shank 15. Thus, once the anchor has landed flat on the bottom of the sea or the bed of a lake, and when the anchor rope 18 is drawn in in the usual manner, the pointed rear part 25 of the wing will dig into the bottom in the same way as occurs with the pivotally attached anchor fluke of a conventional anchor. This is clearly illustrated in FIG. 4, which represents schematically the initial phase of the gripping procedure for the anchor. When a force P is applied to the anchor rope 18, the shank 15 will rise from the wing 20 as it pivots about the articulated link 30. The position of the latter in relation to the part at the very front or the tip of the leading edge of the arrow-shaped wing is, for example, such that the leading edge strikes the under side of the shank 15 at a contact point 31. Further relative movement between the shank and the wing is prevented in this way, and the two elements form with one another an obtuse angle $\gamma$ of appropriate size, such that the rear pointed part of the wing or the anchor fluke 25 is caused to start to dig down, as illustrated in FIG. 4. Once this main part 25 has dug down for a certain distance, the swept back tips 25' of the wing will also act as anchor flukes with points 25' and will start to dig down, and the entire device will soon be securely anchored to the bottom.

It is generally true to state that the pure anchoring function of the anchor in accordance with the invention follows tried and tested principles, and in this respect its function is much the same as that of other articulated anchors of previously disclosed types, and that it affords the same degree of secure attachment to the bottom. The difference is that the anchor in accordance with the invention has a modified design in order to give it the ability to glide through the water, in addition to which the design of the wing part of the anchor makes the anchor self-stabilizing as it glides (due mainly to the 'V'-shape of the wing), so that the anchor will always land 'on an even keel', as it were, on the bottom. Accordingly no canting device, like the usual anchor shank, is required, and similarly there is no need for the duplication of the moving anchor flukes which is essential in previously disclosed anchors if these are to have the ability to grip in whatever position they may arrive on the bottom.

Figure 5:
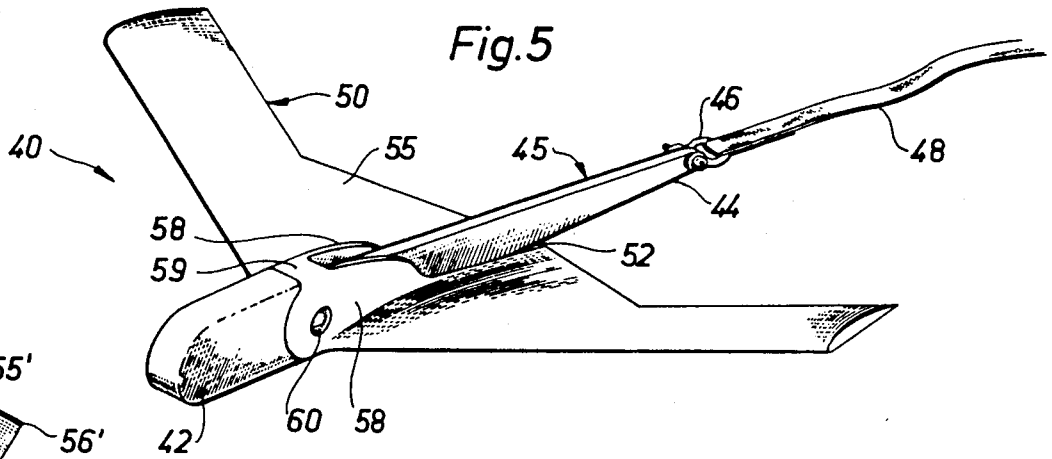
FIG. 5 is a perspective view of a practical embodiment of the anchor in accordance with the invention and shows it viewed at an angle from the front whilst it is gliding forwards through the water.

FIG. 5 shows a perspective view of a practical embodiment of a gliding anchor 40 in accordance with the invention on its way through the water. This embodiment harmonizes fully with that which is represented only schematically in the previous Figures and includes a wing 50. This corresponds to the previously illustrated wing 20 and can be made from pressed and cut sheet metal, although in this case it is a casting. It is made as a single piece with two side arms 58 which are attached at the top and towards the front to a bridge piece 59 and which, as before, constitute the mounting for an articulated link 60. An anchor shank 45 is thus supported between the side arms by means of the articulated link 60, and the shank is terminated at the front by an enlarged part 42 constituting the crown of the anchor. Thus, in its gliding attitude illustrated in FIG. 5, the anchor shank 45 extends from the crown 42 rearwards towards a head 44, to the end of which a shackle or a tube 46 is attached. This in turn is connected to an anchor rope 48 in the form of the previously described strip. The wing executed as a single piece, which in this way corresponds to the pair of arms of the conventional anchor, in this case exhibits a central, shallow groove 52 which extends rearwards from the arms 58 and constitutes a prolongation of the space between these. As before, the wing exhibits a central part 55 which narrows to the rear and constitutes the flukes of the anchor with a tip or point 56 situated at the end of said groove 52.

Figure 6:
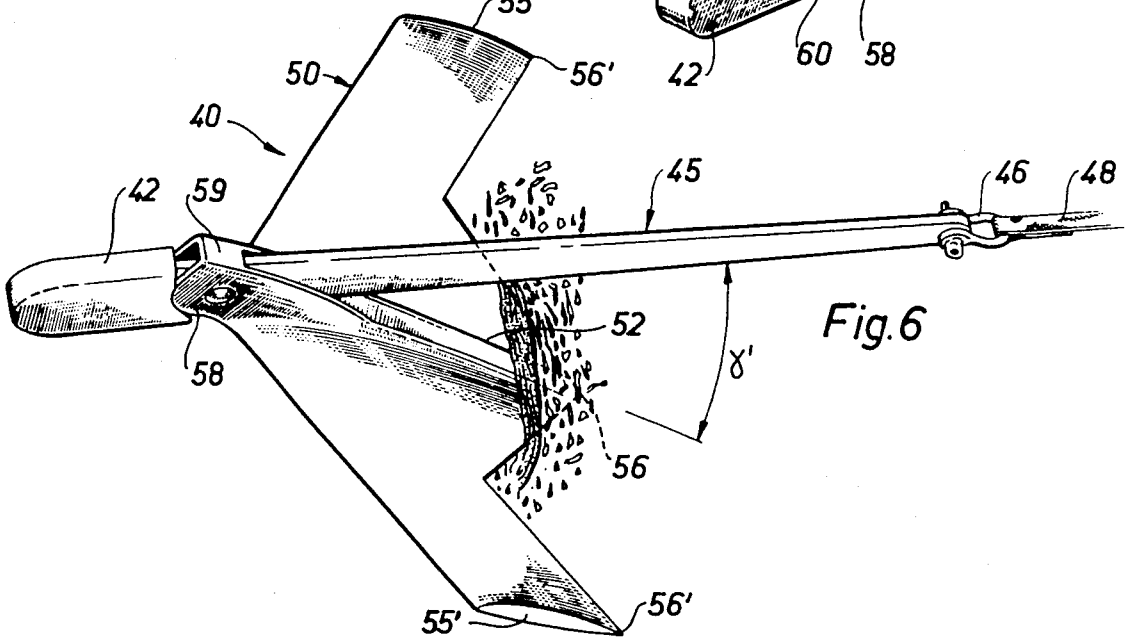
FIG. 6 shows, similarly as a perspective view, the anchor in accordance with FIG. 5 once it has landed on the bottom and whilst it is being dragged into engagement with it.

FIG. 5 thus illustrates the anchor assembly in accordance with the invention as it glides through the water towing the anchor rope 48 behind it FIG. 6 shows the anchor immediately after having landed on the bottom and after a tractive force has been applied to the anchor rope. As previously described, the rearward motion of the anchor is counteracted immediately by the flukes 55 of the wing 50 finding a grip on the bottom or in some other way being arrested by an obstacle. The result of this grip being established is for the anchor shank 45 to rise immediately out of the groove 52 and to pivot about the articulated link 60 through a certain angle $\gamma'$, which is restricted, for example, through contact between the shank and the rear edge of the bridge piece 59. The leading edge of the latter may, furthermore, be utilized in the gliding attitude as a stop against the crown 42, at the same time as the anchor shank or the 'fuselage' 45 rests with its under side against the bottom of the groove 52.

As previously described, the gripping position shown in FIG. 6 as the anchor continues to dig down may also be extended to provide a grip at the pointed trailing edges 56' of the wing at the ends 55' of the wing, which in this case, too constitute additional flukes on the anchor 40. In addition to its ability to glide through the water the anchor in accordance with the invention also exhibits all the characteristics of a conventional anchor with regard to its ability to find a grip and to be retained in the bottom of the sea or on the bed of a lake.

As has already been stated, the anchor in accordance with the invention is self-stabilizing, that is to say it can be dropped into the water in more or less any attitude, whereupon it will right itself on its way down to the bottom and will start its forward glide. It is not possible in practice, however, for the anchor to be handled in this way, because it would lose far too much 'height' in relation to the bottom, with the associated risk of an excessively short gliding distance. The anchor should, instead, be deployed in an approximately horizontal attitude so that it can immediately adopt its 'gliding attitude' and begin its glide, in conjunction with which the anchor is, of course, pointed in the direction of the desired place of anchoring.

More often than not, however, it may prove difficult to deploy the anchor in this way simply by dropping it into the water lying horizontally, especially if the boat has quite a high freeboard. The possibility should, therefore, be available for lowering the anchor gently down into the water lying in the correct attitude, or more precisely with the wing of the anchor in an attitude such that it will immediately adopt the appropriate angle of attack at the start of its glide. It is, of course, preferable for the anchor to be capable of being lowered down gently into the water using the anchor rope, although it will clearly be necessary to take certain precautions since the anchor in accordance with the invention will, in the case of the embodiment illustrated, hang straight down from the end of the rope.

This disadvantage can be overcome, however, by means of a simple arrangement, as represented schematically in FIG. 7. The anchor 40' illustrated here corresponds in all essential respects to the anchor 40 in accordance with FIGS. 5 and 6, although it will be appreciated that a longitudinal slot 47 is formed in the shank 45' of the anchor 40'. The width of the slot matches the dimensions of the transverse bolt of the shackle 46, so that the shackle with its anchor rope 48 attached is able to slide along the slot 47 along most of the length of the shank 45' and as far forwards as a point immediately behind the articulated link 60' of the anchor. At this point the slot 47 exhibits an upward deflection 49 in relation to the shank, as may be appreciated clearly from FIG. 7. What this means is that, if the shackle 46 is pushed forwards and upwards into the deflection 49 and if the anchor is allowed to hang free, the wing 50' of the anchor will pivot downwards about the articulated link 60' at the same time as the anchor shank 45' will swing upwards. The position and the angle of deflection of the deflection 49 are so arranged in this case in relation to the centre of gravity of the entire assembly that the anchor will adopt approximately the attitude shown in FIG. 7, when the bolt of the shackle 46 will be retained in the deflection 49 by the fact that the latter will be inclined slightly upwards in this position. The suspension arrangement described is, on the whole, arranged in such a way that the anchor will hang down with the wing 50' largely horizontal and adopting an appropriate attitude such that, after having been deployed in a straight down direction, it will adopt a gliding attitude as quickly as possible. At the same time as the anchor thus enters the water and its wing 50' supports its weight, the shank 45' will fall and will adopt its normal position in accordance with FIG. 5. In conjunction with the start of the forward gliding motion the shackle 46 is able to slide back in the slot 47, since the tractive force applied to its bolt will displace the latter from the deflection 49 and the tube together with its anchor rope will adopt its normal position at the rear end of the anchor.

The temporary suspension of the anchor in the attitude illustrated in FIG. 7, that is to say for the purpose of lowering it gently down into the water in order to achieve the quickest possible start of the gliding motion of the anchor, can also be achieved by means other than those described above. The anchor rope may, for example, be attached to the end of the anchor in a normal manner, for instance as shown in FIGS. 5 and 6, although it is possible at the front of the anchor shank, approximately at the position of the deflection 49 in the slot in accordance with FIG. 7 described above, to arrange a hook device on the shank for the temporary attachment of the anchor rope strip. The hook device is so executed and arranged for this purpose that the strip will remain suspended from the hook when in a position in accordance with FIG. 7, but will then slide off when the anchor adopts its gliding attitude. It is also possible to position the hook arrangement on the wing next to the shank, in conjunction with which the arrangement is adapted in such a way that the entire assembly will be suspended in a state of equilibrium with the shank lying folded down towards the wing.

It has been assumed for the purposes of simplicity in the foregoing that the pivoting or swinging movement which occurs between the shank and the wing in the anchor in accordance with the invention is achieved through the two elements being connected to one another by means of an articulated link 30, 60 in the form of a bolt or similar. It is, however, pointed out in particular that this articulated link may be entirely imaginary, and that the shank may lie loosely in place between the arms of the wing and may be permitted to move freely between two extreme positions represented by the gliding and digging positions described. If we look at FIG. 5 it will be seen that, if the link 60 is removed, the shank 45 is able to remain in its position because of its own mass and to rest against the wing 50 in the groove 52 of the latter, and that a tractive force applied to the shank in a rearward sense will be absorbed through contact between rear edges of the crown 42 and the front edges of the bridge piece 59 and the arms 58. In the digging positions shown in FIG. 6 the tractive force is transferred to the anchor shank 45 through the side parts of the crown 42 coming into contact with the, in this case, rounded front edges of the wing arms 58, as shown in FIG. 6. In addition the top surface of the shank 45 comes into contact with the rear edge of the bridge piece 59, as described previously, whereby the extreme position of the shank in this direction, that is to say its digging position, is fixed. It is not possible, however, from a practical point of view simply to omit the bolt 60 in this way, since there is nothing to prevent the shank 45 from moving forwards in relation to the wing 50. It is obvious that the shank would constantly fall forwards between the arms 58 whenever the anchor was being handled on board the ship, and even if the tube 46 at the rear end of the shank were to prevent the shank from falling out completely, handling would still be a cumbersome operation. There would be advantages to be gained if, on the other hand, the possibility were to be afforded of withdrawing the anchor shank from its holder on the wing in a simple fashion, as this would very much facilitate stowing the anchor on board.

FIG. 8 thus represents schematically a central vertical section through an anchor 70 which harmonizes in its principal characteristics with the anchor 40 described previously, but the wing of which consists of a robust sheet of steel cut into a straight flat form and bent in a single direction at the centre, with arms welded in position on the upper side. The anchor 70 thus consists, as before, of an anchor shank 75 with a front crown 72 and a wing 80 in accordance with the above, a central section through which is shown in FIGS. 8 and 9, together with arms 88 which, as already mentioned, are welded in position on the upper side of the wing, one to eight side of the shank. The arms 88 are attached to a bridge piece 89 at the top and towards the front. Thus, as has already been pointed out, the anchor 70 exhibits the same general configuration as the anchor 40 in accordance with FIGS. 5 and 6.

A heel 87 is attached at the leading edge of the central section of the wing 80, said heel being the same width as the shank 75 and having more or less the same cross-sectional form shown in FIGS. 8 and 9. The anchor shank 75 is provided with a corresponding recess 77 into which the heel 87 fits, and in the normal attitude or the gliding attitude of the anchor, the anchor shank and the wing will interact in the manner illustrated in FIG. 8. It will immediately be obvious that this interaction involves the shank 75 being prevented by the heel 87 from moving in a longitudinal sense relative to the wing 80, and it should be noted in this context that this locking effect of the heel - which thus prevents the shank 75 from sliding forwards to the left, as seen in the Figure - is present for most of the upward pivoting motion of the shank; see below.

In this case the rear part of the crown of the anchor is executed with an angled contact plane 73 so arranged as to make contact, when in its normal position, with corresponding angled surfaces, these sharing the common designation 93 and being executed on the front edges of the arms 88 and the bridge piece 89. This normal position is thus shown in FIG. 8.

After having landed on the bottom, and once a tractive force has been applied to the anchor shank 75 via the anchor rope so as to cause the anchor fluke to find a hold in the manner described previously, it is obvious that the shank 75 will pivot about a leading edge 90 of the central section of the wing 80. This edge 90 thus constitutes the articulated link of the anchor in this case, and the operating procedure will be the same as before, that is to say the wing 80 with its anchor fluke (not shown in FIGS. 8 and 9) will be folded down and into an extreme position, which is determined in this case by the upper side of the anchor shank 75 coming up against an inclined contact surface 92 along the trailing edge of the bridge piece 89. In order to permit the pivoting movement about the edge 90 the trailing edge of the lower part of the anchor crown 72 is inclined along a plane 73, as shown in FIG. 8. The angle of inclination is such that, at the same time as the extreme position is reached, that is to say when the upper side of the shank comes into contact with the contact surface 92 on the bridge piece 89, the inclined surface 73 will also make contact with a corresponding surface 81 along the leading edge of the central section of the wing 80. This surface 81 lies on the same plane as the plane 93 of the leading edge of the arms 88 and the bridge piece 89, and as will have been appreciated from the foregoing, the edge 90 of the articulated link will be present at the upper end of said leading edge surface 81 of the wing. The aforementioned locking heel 87 on the wing is also present at this point.

The anchor in accordance with FIGS. 8 and 9 functions, as has already been mentioned, in precisely the same fashion as previously described in conjunction with the other embodiments of the anchor, in which case the anchor shank 75 and the wing 80 interact in such a way in both the gliding attitude and the digging attitude that all necessary transmission of force between these principal component parts of the anchor takes place in an effective fashion through the necessary degree of interaction between the contact surfaces. The anchor shank 75 is thus prevented in this way from moving in the direction indicated by the arrow L in relation to the wing 80. Provision is made at the same time, thanks to the heel 87 on the wing 80 and the interacting recess 77 in the shank 75, to prevent the latter from being able to move unintentionally in the opposite direction indicated by the arrow R in FIG. 9, with the single exception of the case indicated in that Figure, that is to say when the shank has arrived in its extreme position for digging. In this relative position between the components the heel 87 will be released from the recess 77 and it will be possible to withdraw the shank from the wing in the direction indicated by the arrow R (if necessary, after having disconnected the tube of the anchor rope from the shank). When the anchor is being handled in this way on board, the risk of the anchor shank falling out unintentionally will be small, since the heel 87 with its interacting recess 77 will prevent this from happening in most positions. In order to separate the shank and the wing it is necessary to move the components intentionally into the extreme position for digging and then to draw them apart. For this purpose the heel 87 should preferably be executed in such a way that it will permit the anchor shank to be withdrawn only if a certain level of friction is overcome, which additionally contributes to the anchor components not being separated unintentionally. It is of considerable benefit if, on the other hand, as has already been mentioned, the anchor is capable of being dismantled easily for stowing on board.

Finally, it must be pointed out that the surprising ability to cause a comparatively heavy anchor to glide forwards at an angle through the water, and not to sink straight down, can also be achieved through anchor designs other than those presented here exclusively for exemplifying purposes. By adhering to the fundamental principal of the invention it is possible to conceive other practical embodiments, and it should be possible in particular to modify and to render the 'digging elements' of the anchor more effective in a variety of ways, that is to say those elements which correspond to the fluke of the conventional anchor and which do not necessarily require to be attached in a more or less direct fashion to those devices which provide the anchor with its gliding capability. It should be possible for an expert to propose various modifications within the context of the following Patent claims, and the invention is thus in no way restricted to the embodiments illustrated and described.

I claim:

1. A boat and vessel anchor so arranged as to find a hold on the bottom, at a point at a considerable horizontal distance from the point at which the boat or the vessel drops the anchor, by gliding front end first through the water along an inclined plane, the anchor comprising a central, elongated shank arranged for the attachment of an anchor rope or the like, a wing comprising a pair of transverse arms attached to the front part of the shank and extending outwards each from its own side of the shank in generally symmetrical relation to it, each arm being platelike and shaped to comprise half of a wing, the plane of each arm extending substantially parallel to the anchor shank, the wing-shaped arms of the anchor being securely attached to one another or made in one piece so that the wing is continuous, a central portion of the wing extending rearwards and tapering to a point, means pivotally connecting the wing as a whole with the shank for (1) providing lift when adjacent the shank and, once the anchor has reached the bottom and a pull is applied to the anchor rope, for (2) pivoting away from said shank and digging into the bottom with its central, tapering portion, the latter of which constitutes a pivotable anchor fluke.

2. An anchor according to claim 1, wherein the wing as a whole has a "V" shape as seen from the front end of the shank, the shank resting in the central part of the "V", the wing having an arrow shape with swept back wing tips as seen from above, the rear parts of said swept back wing tips defining additional anchor flukes.

3. An anchor according to claim 1, wherein the shank is accommodated between two ribs or bars arranged on the upper side of the wing, the aforementioned pivot connection between the wing and the shank being near the front edge of the wing.

4. An anchor according to claim 1, wherein the wing consists of a metal plate cut into an arrow shape having an axis of symmetry, or welded together from small pieces into this shape, said plate being bent in a single direction about a central axis parallel to said axis of symmetry so as to achieve a "V" shape as seen from the front of said shank.

5. An anchor according to claim 3, wherein the upper edges of the bars are connected at their front ends by a bridge piece which extends over the anchor shank, that part of said shank situated in front of the bars being expanded to form a crown provided with contact surfaces which, with the anchor in its normal gliding attitude, engage with corresponding surfaces on the bars and/or on the bridge piece, and wherein the pivot connection between the wing and the shank of the anchor is provided by a rear section of the under part of the crown being tiltable against an opposite leading edge of the wing, such pivoting motion of the wing to the digging position being restricted by a contact surface on the rear edge of the bridge piece striking the upper side of the anchor shank.

6. An anchor according to claim 1, including an anchor rope and means normally attaching the anchor rope to the rear end of the shank, but (1) actuable for engaging the anchor rope in a temporary fashion with, and to support, the anchor at a point above the centre of gravity of the anchor in such a way that the anchor can be lowered gently down for the purpose of its deployment supported from the anchor rope and with the wing adopting an appropriate, optimum attitude for it immediately to start its glide through the water, and (2) responsive to forward motion of said anchor in said glide for releasing the anchor rope from its temporary engagement with the anchor and returning to said normal attachment with the rear end of the shank.

7. An anchor according to claim 6, wherein said rope attachment means comprises a shackle fixed to the anchor rope and a longitudinal slot in the anchor shank in which the shackle is adapted to run from a normal position at the rear end of the shank to a lowering position close to the centre of gravity of the anchor, the slot having an upward deflection such that the shackle with its attached anchor rope is retained in the deflection allowing the anchor to hang freely in its lowering attitude, but slides out of engagement in the deflection and back along the slot to its normal position when the anchor starts its glide and the anchor rope is directed backwards.

8. An anchor for anchoring watercraft with respect to the bottom of a body of water, comprising:

an elongate shank having front and rear ends and means for securing an elongate flexible rode to said shank and therewith for exerting a rearward pull on said rear end of said shank to seat the anchor in the bottom;

lateral structure carried by said shank, said lateral structure comprising;

(a) a central, rear pointing, anchor fluke centered beneath said shank;

(b) means pivotally mounting said fluke for pivoting from (1) a gliding position snugly under said shank to (2) an anchoring position in which the central anchor fluke slopes downward and rearward away from the underside of said shank to dig into the bottom in the body of water;

(c) glide enabling means responsive to release of the anchor in the body of water for enabling the anchor to glide obliquely forward in the water along a shallow glide path away from the watercraft and therewith to reach the bottom at a substantial distance from the watercraft, which distance corresponds to a multiple of the water depth, said glide enabling means defining at least part of a platelike wing located intermediate the ends of said shank, said wing extending symmetrically laterally away from opposite sides of said shank, to define right and left wing arms.

9. The apparatus of claim 8, in which said wing has a central front portion and a rear portion, said means pivotally mounting said fluke comprising means pivoting the central front portion of said wing to said shank for limited pivoting movement of the rear portion of said wing from (1) an upper glide position in which said wing rear portion supports thereatop the overhanging portion of the shank for gliding, to (2) a lower anchoring position downwardly angled from said shank in which lower position said wing rear portion is engage-able with the bottom of the body of water for anchoring, said wing rear portion comprising said rearward pointing anchor fluke.

10. The apparatus of claim 8, in which said wing has swept back forward and rearward edges of substantially constant fore-aft width, said wing being bent to receive the bottom of the shank in a fore-aft central depression therein at which the laterally inner ends of the wing arms join, the wing arms sloping upward and laterally outward from said depression to define a V-shape as seen from the front of the shank, the laterally outer tips of said swept back wing arms forming rearward directed points, the rear pointing central anchor fluke being behind said rearward directed wing tip points for digging into the bottom before said wing tip points reach the bottom, said wing tip points helping to prevent tilting of said anchor to the right or left of the shank upon engagement of the central fluke with the bottom.

11. The apparatus of claim 10, in which said wing arms are of air foil cross section, being convex on the top and substantially flat on the bottom thereof.

12. The apparatus of claim 8, in which the wing is laterally wider than its length longitudinally of the shank, said anchor having a glide path with a vertical to horizontal travel ratio in the range of between 1:4 and 1:5.

* * * * *